US008200147B2

(12) United States Patent
Lee et al.

(10) Patent No.: US 8,200,147 B2
(45) Date of Patent: Jun. 12, 2012

(54) WIRELESS COMMUNICATION SYSTEM FOR CONTROLLING COMMUNICATION AREA BY JAMMING

(75) Inventors: Hee-Jo Lee, Namyangju (KR); Yu-Seung Kim, Suwon (KR); Hyogon Kim, Songpa-Gu (KR)

(73) Assignee: Korea University Industry and Academy Collaboration Foundation, Seoul (KR)

( * ) Notice: Subject to any disclaimer, the term of this patent is extended or adjusted under 35 U.S.C. 154(b) by 231 days.

(21) Appl. No.: 12/626,160

(22) Filed: Nov. 25, 2009

(65) Prior Publication Data

US 2011/0092152 A1 Apr. 21, 2011

(30) Foreign Application Priority Data

Oct. 16, 2009 (KR) ..... 10-2009-0098814

(51) Int. Cl.
*H04K 3/00* (2006.01)

(52) U.S. Cl. .... 455/1; 455/456.2; 455/67.11; 455/67.13

(58) Field of Classification Search ..... 455/1, 414.1, 455/414.2, 446, 456.1, 456.3, 515, 434, 63.1, 455/67.11, 69, 67.13, 456.2, 278.1; 342/173, 342/13

See application file for complete search history.

(56) References Cited

U.S. PATENT DOCUMENTS

| | | | | |
|---|---|---|---|---|
| 5,295,180 | A | 3/1994 | Vendetti et al. | |
| 2005/0020244 | A1 * | 1/2005 | Chang et al. | 455/410 |
| 2006/0264168 | A1 * | 11/2006 | Corbett et al. | 455/1 |
| 2007/0200688 | A1 * | 8/2007 | Tang et al. | 340/426.18 |

FOREIGN PATENT DOCUMENTS

| | | | |
|---|---|---|---|
| JP | 2003-101516 | A | 4/2003 |
| KR | 10-2003-0081203 | A | 10/2003 |

* cited by examiner

*Primary Examiner* — John J Lee

(74) *Attorney, Agent, or Firm* — Gifford, Krass, Sprinkle, Anderson & Citkowski, P.C.

(57) ABSTRACT

A wireless communication system for geographically controlling a communication area includes an access point for communicating with a terminal in a first area, and a jammer for generating noise for intercepting communication between the access point and a terminal in a second area. A jamming boundary for dividing an area in which the terminal can communicate with the access point and an area in which the terminal cannot communicate with the access point in an area in which the first area and the second area are overlapped is formed, and the jamming boundary is formed by a ratio between power of a signal transmitted to the terminal by the access point and power of a signal of the noise.

7 Claims, 6 Drawing Sheets

(A) $P_{AP} = 4P_j$ for $n = 4$, $P_{AP} = 2P_j$ for $n = 2$ (B) $P_{AP} = P_j$ for both $n = 4$ and $n = 2$ (C) $4P_{AP} = P_j$ for $n = 4$, $2P_{AP} = P_j$ for $n = 2$

WIRELESS COMMUNICATION SYSTEM FOR CONTROLLING COMMUNICATION AREA BY JAMMING

CROSS-REFERENCE TO RELATED APPLICATION

This application claims priority to and the benefit of Korean Patent Application No. 10-2009-0098814 filed in the Korean Intellectual Property Office on Oct. 16, 2009, the entire contents of which are incorporated herein by reference.

BACKGROUND OF THE INVENTION (a) Field of the Invention

The present invention relates to wireless network security.

(b) Description of the Related Art

As wireless communication techniques have been developed, company information leakage through wireless networks has become a serious problem. In order to prevent illegal access to the wireless network environment from the outside, many methods such as user authentication and data encryption have been proposed, but they generate information leakage in subsequent cases.

FIG. 1 shows a general wireless network environment of a company.

Referring to FIG. 1, a plurality of access points AP1 and AP2 and terminals T1, T3, and T4 are provided in a physical perimeter $PA_E$ of a company, and a plurality of access points AP3 and AP4 and a terminal T2 are provided outside the physical perimeter $PA_E$.

The access point AP1 and the terminal T1 in the physical perimeter $PA_E$ of the company communicate with each other in the normal case, and when an external rogue terminal T2 hacks the key for authentication to communicate with the internal access point AP2 (Case 1) or an internal rogue terminal T3 forms another channel with a rogue access point AP3 and communicates with the same (Case 2), the company's information may be leaked.

Further, when an internal innocent terminal T4 communicates with an external rogue access point AP4 unintentionally by an automatic wireless connection manager program (Case3), information leakage occurs. Therefore, to fundamentally intercept the company's information leakage, it is required to isolate a specific geographical area from the wireless access to/from the outside.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a wireless communication system for geographically controlling a communication area caused by an access point by using jamming.

An exemplary embodiment of the present invention provides a wireless communication system for geographically controlling a communication area including an access point for communicating with a terminal in a first area, and a jammer for generating noise for intercepting communication between the access point and a terminal in a second area. A jamming boundary for dividing an area in which the terminal can communicate with the access point and an area in which the terminal cannot communicate with the access point in an area in which the first area and the second area are overlapped is formed, and the jamming boundary is formed by a ratio between power of a signal transmitted to the terminal by the access point and power of a signal of the noise.

When power of the signal transmitted to the terminal by the access point corresponds to power of the noise generated by the jammer, the jamming boundary is formed at a point having the same distance from the access point and the jammer, respectively.

The jamming boundary moves toward the access point as power of the noise is increased compared to power of a signal transmitted to the terminal by the access point, and the jamming boundary moves toward the jammer as power of the noise is decreased compared to power of a signal transmitted to the terminal by the access point.

The jamming boundary is proportional to the distance between the access point and the terminal and the distance between the jammer and the terminal, and signal power of the access point received by the terminal corresponds to power of the noise received by the terminal at the jamming boundary.

DETAILED DESCRIPTION OF THE EMBODIMENTS

Figure 1:
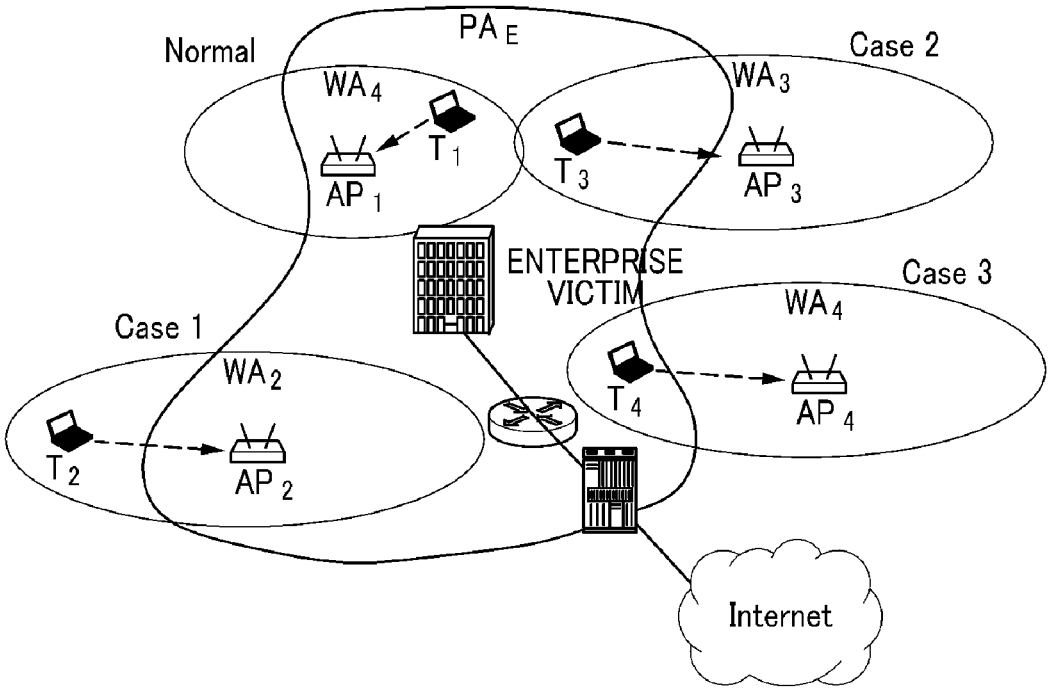
FIG. 1 shows a general wireless network environment of a company.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" and variations such as "comprises" or "comprising" will be understood to imply the inclusion of stated elements but not the exclusion of any other elements.

In the specification, an access point (AP) may indicate a base station (BS), a node B, an evolved node B (eNodeB), a radio access station (RAS), a base transceiver station (BTS), and a mobile multihop relay (MMR)-BS, and it may include entire or partial functions of the node B, the eNodeB, the AP, the RAS, the BTS, and the MMR-BS.

Also, a terminal may indicate an access terminal (AT), a mobile terminal (MT), a mobile station (MS), a subscriber station (SS), a portable subscriber station (PSS), and user equipment (UE), and it may include entire or partial functions of the AT, the MT, the MS, the SS, the PSS, and the UE.

In the present specification, a jamming boundary represents a boundary where a communication area of an access point is controlled by a jammer, and the communication area controlled by the jammer is defined to be a protected wireless zone.

A wireless communication system according to an exemplary embodiment of the present invention will now be described in detail with reference to accompanying drawings.

Figure 2:
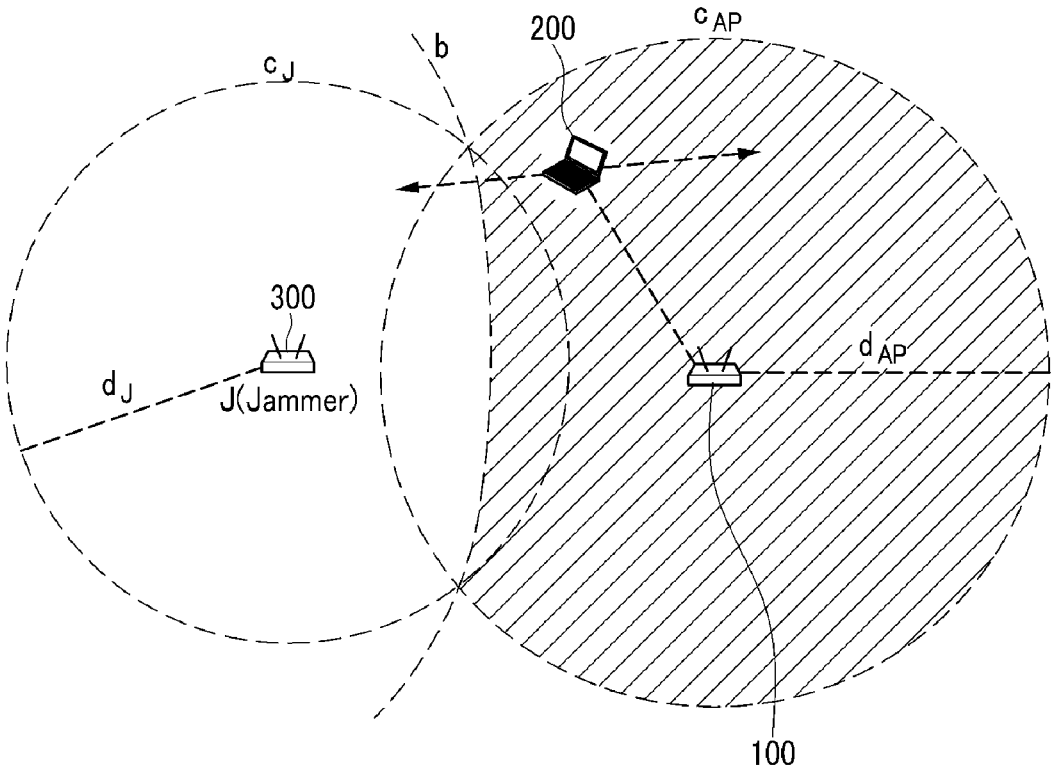
FIG. 2 shows a wireless communication system according to an exemplary embodiment of the present invention.

FIG. 2 shows a wireless communication system according to an exemplary embodiment of the present invention. Referring to FIG. 2, the wireless communication system includes an access point 100, a terminal 200, and a jammer 300.

The access point 100 communicates with the terminal 200 through a specific frequency. In this instance, received signal power $P_R$ of the access point 100 received by the terminal 200 is expressed in Equation 1.

$$P_R = G_{AP-T} \cdot P_{AP} \cdot G_{T-AP} \frac{\lambda^2}{(4\pi)^2 (A_{AP-T})^n} \quad \text{[Equation 1]}$$

Here, $G_{AP-T}$ represents an antenna gain of the access point 100 in the direction of the terminal 200, $P_{AP}$ indicates signal power output by the antenna, and $G_{T-AP}$ shows an antenna gain of the terminal 200 in the direction of the access point 100. Also, $\lambda$ represents wavelength of a signal output by the antenna of the access point 100, and $D_{AP-T}$ is a distance between the access point 100 and the terminal 200.

Figure 3:
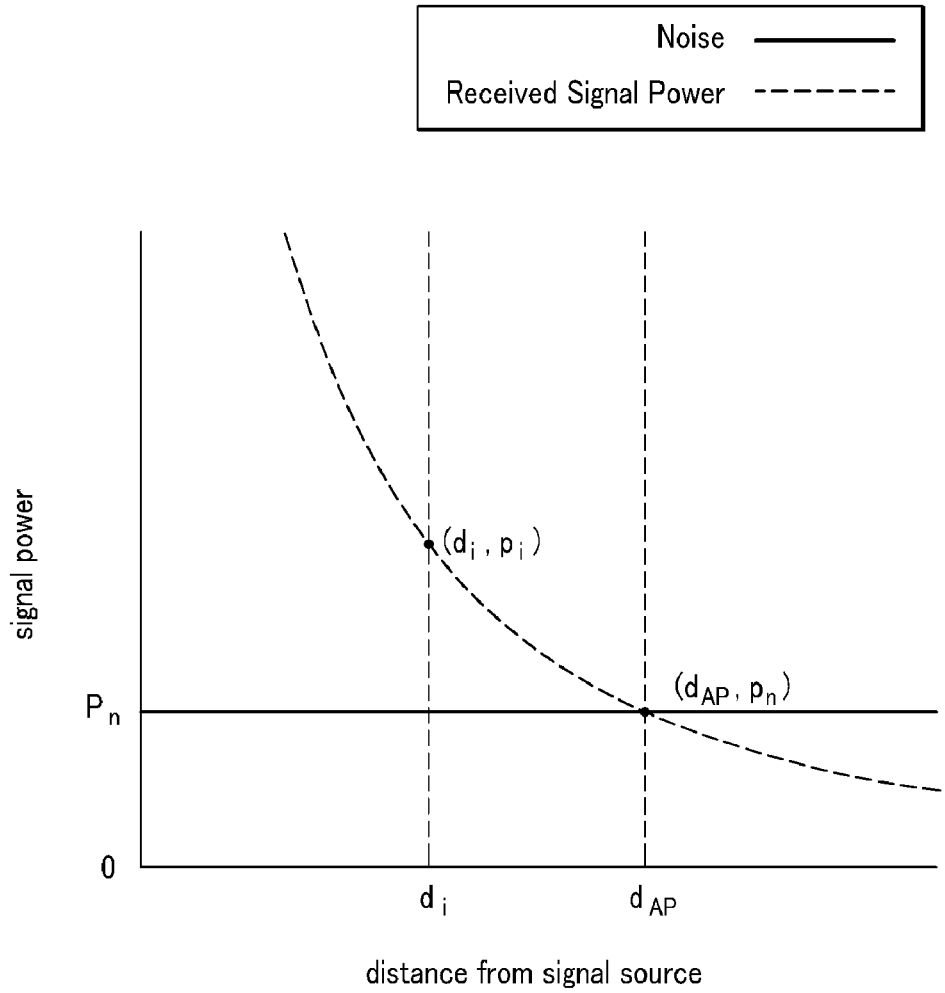
FIG. 3 shows signal power $P_R$ of an access point 100 received by a terminal 200 based on the distance between the access point 100 and the terminal 200.

The signal power $P_R$ of the access point 100 received by the terminal 200 in Equation 1 can be shown as FIG. 3 based on the distance between the access point 100 and the terminal 200.

Referring to FIG. 3, signal power of the access point 100 received by the terminal 200 is reduced as the terminal 200 becomes far from the access point 100.

When noise power $P_n$ is constant in FIG. 3, the signal-to-noise ratio (SNR) at the distance $d_i$ from the access point 100 is $P_i/P_n$, and the SNR at the point ($P_{AP}=P_n$) where power of the signal and the noise is the same becomes 1 (0 dB).

In this instance, the case in which the SNR is 1 represents that the terminal 100 receives no signal from the access point 100, and the terminal 200 can communicate with the access point 100 in the area $C_{AP}$ included in the circle with the radius $d_{AP}$ with respect to the access point 100. That is, in FIG. 2 the area $C_{AP}$ that is included in the circle with the radius $d_{AP}$ with respect to the access point 100 indicates the area where the terminal 200 can communicate with the access point 100.

Further, in FIG. 2, the jammer 300 generates and transmits noise so as to present an obstacle to communication by the terminal 200 with the access point 100. The signal power of the jammer 300 received by the terminal 200 is reduced as the terminal 200 is far from the jammer 300 as shown in FIG. 3, and the SNR becomes 1 at the point ($P_J=P_n$) where the jammer's noise and noise power are equal (0 dB).

In this instance, the case in which the SNR is 1 signifies that the terminal 100 is no longer influenced by the noise of the jammer 300, and the terminal 200 receives noise caused by the jammer 300 in the area $C_J$ included in the circle with the radius $d_J$ with respect to the jammer 300. That is, in FIG. 2, the area $C_J$ included in the circle with the radius $d_J$ with respect to the jammer 300 represents the area where the terminal 200 receives noise from the jammer 300.

In FIG. 2, a jamming boundary (b) is formed in the common area of the area $C_A$ in which the terminal 200 can communicate with the access point 100 and the area ($C_J$) in which the terminal 200 receives noise from the jammer 300.

When the terminal 200 is provided on the side of the access point 100 with reference to the jamming boundary (b) in the common area, the terminal 200 can receive a signal of the access point 100, and when the terminal 200 is provided on the side of the jammer 300 with reference to the jamming boundary (b), the terminal 200 cannot receive the signal of the access point 100 because of noise of the jammer 300.

The signal power $P_R$ of the access point 100 received by the terminal 200 on the jamming boundary (b) corresponds to the signal power of the jammer 300 received by the terminal 200, and satisfies Equation 2.

$$\frac{P_{AP-T}}{P_{J-T}} = \frac{G_{AP-T} \cdot P_{AP} \cdot G_{T-AP} \frac{\lambda_{AP}^2}{(4\pi)^2 (D_{AP-T})^n}}{G_{J-T} \cdot P_J \cdot G_{T-J} \frac{\lambda_J^2}{(4\pi)^2 (D_{J-T})^n}} = 1 \quad \text{[Equation 2]}$$

Here, $P_{AP-T}$ represents signal power received by the terminal 200 from the access point 100, and $P_{J-T}$ indicates signal power received by the terminal 200 from the jammer 300.

In this instance, assuming that the access point 100 and the jammer 300 use the same antenna and frequency ($G_{AP-T}=G_{J-T}$, $G_{T-AP}=G_{T-J}$ and $\lambda_{AP}=\lambda_J$), Equation 2 can be expressed as Equation 3.

$$P_{AP}:P_J=(D_{AP-T})^n:(D_{J-T})^n \quad \text{[Equation 3]}$$

According to Equation 3, the jamming boundary (b) depends on power of the access point 100 and the jammer 300, and distance among the access point 100, the jammer 300, and the terminal 100.

In detail, the form of the jamming boundary (b) according to power of the access point 100 and the jammer 300 will be described.

Figure 4:
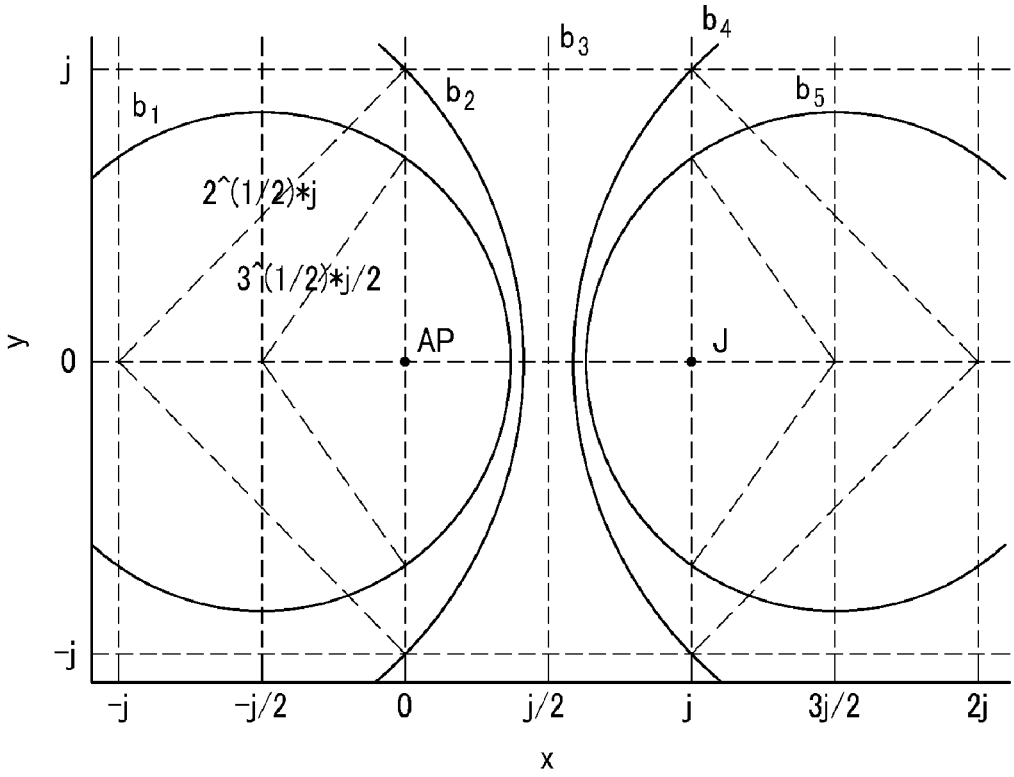
FIG. 4 shows a form of a jamming boundary (b) according to power of an access point 100 and a jammer 300.

FIG. 4 shows a form of a jamming boundary (b) according to power of an access point 100 and a jammer 300, and Table 1 shows a power relation of the access point 100 and the jammer 300 for the jamming boundary (b) of FIG. 4.

TABLE 1

| Loss Exponent | n = 2 | n = 4 |
|---|---|---|
| $b_1$ | $3P_A = P_J$ | $9P_A = P_J$ |
| $b_2$ | $2P_A = P_J$ | $4P_A = P_J$ |
| $b_3$ | $P_A = P_J$ | $P_A = P_J$ |
| $b_4$ | $P_A = 2P_J$ | $P_A = 4P_J$ |
| $b_5$ | $P_A = 3P_J$ | $P_A = 9P_J$ |

In FIG. 4, the access point 100 is provided at (0,0) in the x-y plane, and the jammer 300 is provided at (j,0) in the x-y plane.

Referring to FIG. 4 and Table 1, when the access point 100 and the jammer 300 have the same power, the jamming boundary (b) is formed by the straight line (b3) generated by connecting the points having the same distance from the access point 100 and the jammer 300, respectively.

As power $P_J$ of the jammer 300 is increased in proportion to power $P_{AP}$ of the access point 100, the jamming boundary (b) approaches the access point 100.

In detail, when power $P_J$ of the jammer 300 becomes four times the power $P_{AP}$ of the access point 100 (i.e., $P_J=4P_{AP}$), the jamming boundary (b) forms a circle (b2) with the center of (−j,0) and the radius of 2^(½)*j. Also, when power $P_J$ of the jammer 300 becomes nine times the power $P_{AP}$ of the access point 100 (i.e., $P_J=9P_{AP}$), the jamming boundary (b) forms a circle (b1) with the center of (−j/2,0) and the radius of 3^(½) *j/2.

That is, as power $P_J$ of the jammer 300 is increased compared to power $P_{AP}$ of the access point 100, the center of the circle forming the jamming boundary (b) moves towards the access point 100, and the radius of the circle forming the jamming boundary (b) is reduced.

On the contrary, when power $P_{AP}$ of the access point 100 is increased to be greater than the power $P_J$ of the jammer 300, the jamming boundary (b) is formed near the jammer 300 (b4) and (b5).

Here, the loss exponent (n) is variable by environmental conditions, and it is given as 2 in the free space (n=2), it is given as 4 on the flat surface (n=4), and it is given as greater than 4 in the internal space except the tunnel. FIG. 4 shows the case of a flat surface (n=4).

The case in which an access point 100 is surrounded by a plurality of jammers 300_1, 300_2, . . . 300_*n* will now be described.

When K jammers 300_1, 300_2, . . . 300_*k* using the same frequency are provided near the access point 100, signal power $P_R$ of the access point 100 received by the terminal 200 is expressed in Equation 4.

$$P_R = P_{AP-T} + \sum_{i}^{k} P_{J,S} + N \quad \text{[Equation 4]}$$

Here, $P_{AP-T}$ represents signal power from the access point 100, $P_{JiS}$ indicates signal power from the i-th jammer (Ji, 300_*i*), and N is an environmental noise floor. That is, a plurality of jammers 300_1, 300_2, . . . 300_*k* obstruct the terminal 200 in receipt of a signal from the access point 100.

In this instance, if the environmental noise floor N is ignored, the SNR at the point (x,y) is expressed in Equation 5.

$$SNR = \frac{P_{AP-T}(x, y)}{\sum_{i}^{k} P_{J,T}(x, y)} \quad \text{[Equation 5]}$$

Here, $P_{JiT}(x,y)$ represents the function of (x,y) for indicating signal power transmitted from the jammer (300_i, $J_i$) to the point of (x,y), and can communicate with the access point 100 in the area having the value of Equation 5 that is greater than 1.

In the situation of a plurality of jammers 300_1, 300_2, . . . 300_*k*, the area that can be communicated with the access point 100 is included in the area where the areas available for communication with the access point 100 for a plurality of respective jammers 300_1, 300_2, . . . 300_*k* are overlapped.

In this instance, when the area available for communication with the access point 100 is intercepted from the outside, the intercepted area will be called a "secure wireless zone."

Hereinafter, the secure wireless zone will be described in detail with reference to FIG. 5 and FIG. 6.

Figure 5:
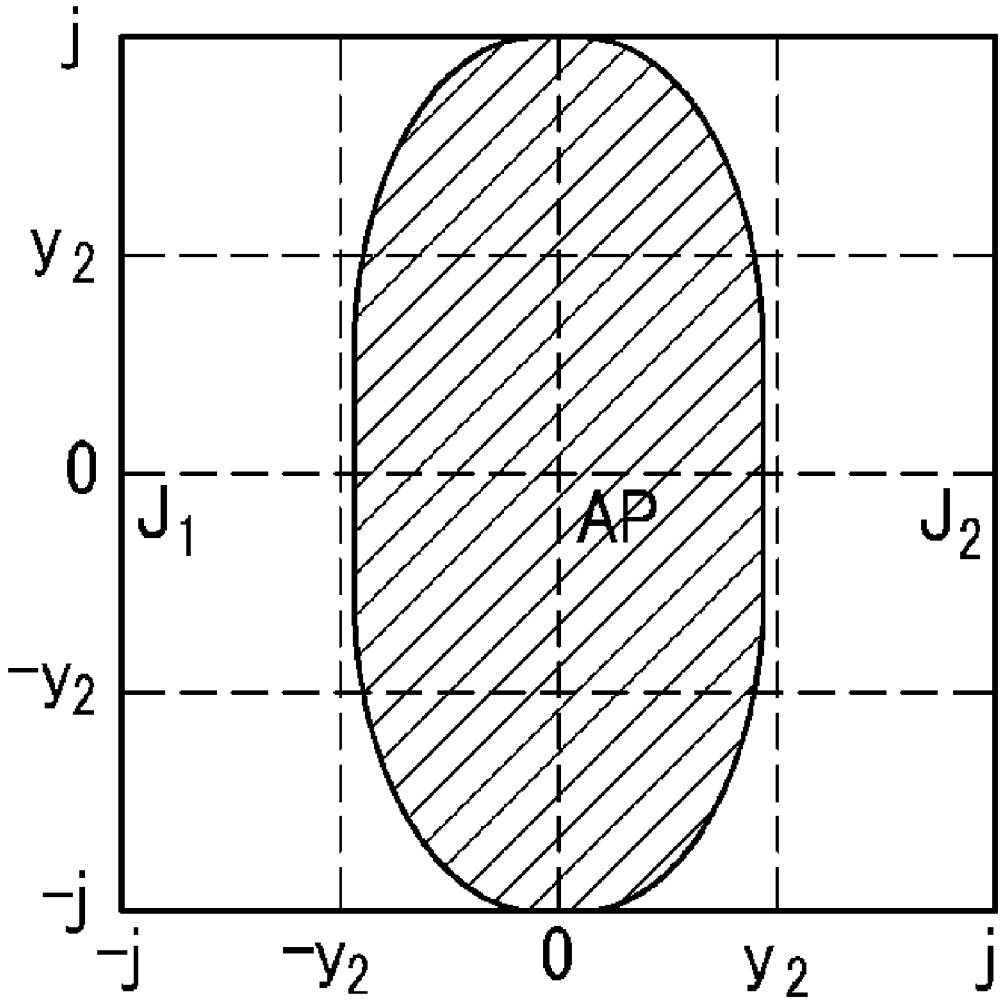
FIG. 5 shows a secure wireless zone formed when two jammers J1 and J2 are provided near an access point 100.

FIG. 5 shows a secure wireless zone formed when two jammers J1 and J2 are provided near an access point 100.

The jamming boundary (b) is formed at the point where signal power ($P_R$) of the access point 100 received by the terminal 200 according to Equation 2 corresponds to a summation of signal power of the jammers J1 and J2 received by the terminal 200. In detail, the jamming boundary (b) is formed as in Equation 6.

$$\frac{P_{AP-T}(x, y)}{P_{J_1T}(x, y) + P_{J_2T}(x, y)} = 1 \quad \text{[Equation 6]}$$

Assuming that the access point 100 is provided at (0,0) on the x-y plane, J1 is provided at (−j,0), J2 is provided at (j,0), the terminal 200 is provided at (x,y), and the access point 100 and the jammers J1 and J2 use the same antenna and frequency ($G_{AP-T}=G_{J1-T}=G_{J2-T}$, $G_{T-AP}=G_{T-J1}=G_{T-J2}$ and $\lambda_{AP}=\lambda_{J1}=\lambda_{J2}$), Equation 6 can be expressed as Equation 7.

$$\frac{P_{AP}}{(D_{AP-T})^n} = \frac{P_{J_1}}{(D_{J_1T})^n} + \frac{P_{J_2}}{(D_{J_2T})^n} \quad \text{[Equation 7]}$$

Assuming that the loss exponent is n=2, and $P_{AP}=P_{J1}=P_{J2}$ in the free space, the jamming boundary is expressed as Equation 8.

$$\frac{1}{x^2 + y^2} = \frac{1}{(x - j)^2 + y^2} + \frac{1}{(x + j)^2 + y^2} \quad \text{[Equation 8]}$$

In FIG. 5, the inner part of the jamming boundary with respect to the access point 100 is a "secure wireless zone."

Figure 6:
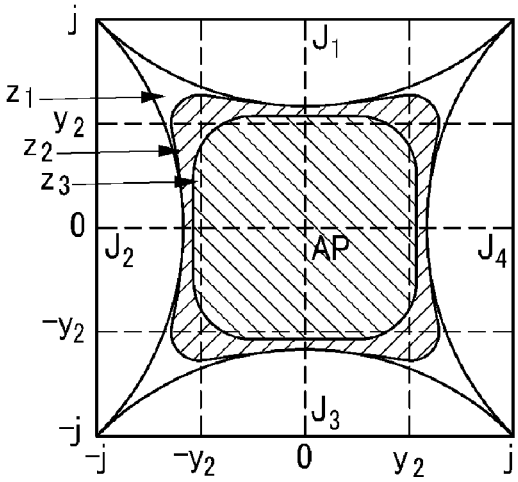
FIG. 6 shows a secure wireless zone formed when four jammers J1, J2, J3, and J4 are provided near an access point 100.
Figure 6:
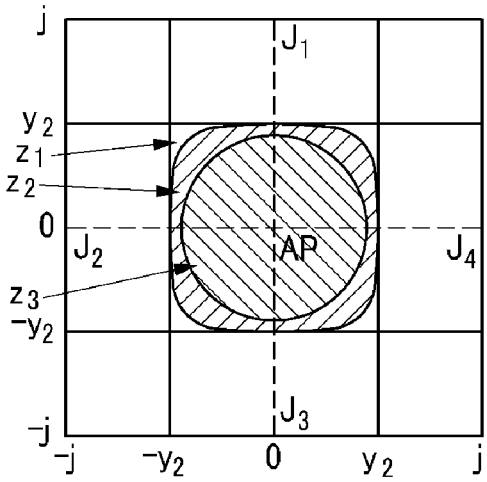
Figure 6:
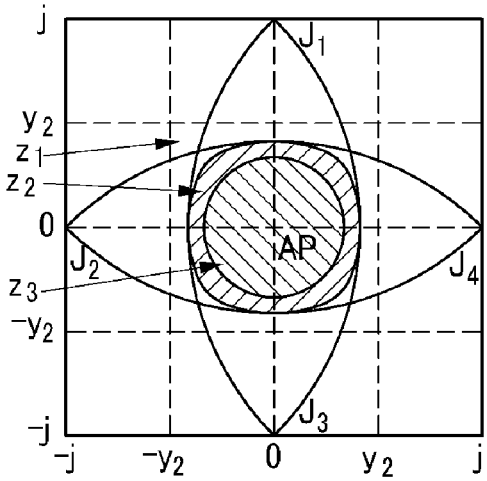

FIG. 6 shows a secure wireless zone that is formed when four jammers J1, J2, J3, and J4 are provided near the access point 100. In this instance, the distance between the jammers J1, J2, J3, and J4 and the access point 100 is given as j.

In FIG. 6, 3 cases including the first case in which power $P_J$ of the four jammers J1, J2, J3, and J4 is respectively less than power $P_{AP}$ of the access point 100 ($P_{AP}>P_J$), the second case in which power $P_J$ of the four jammers J1, J2, J3, and J4 is respectively equal to power $P_{AP}$ of the access point 100 ($P_{AP}=P_J$), and the third case in which power $P_J$ of the four jammers J1, J2, J3, and J4 is respectively greater than power $P_{AP}$ of the access point 100 ($P_{AP}<P_J$) are applicable.

Referring to the power relationship between the access point 100 and the jammer 300 and the jamming boundary (b) of Table 1, in FIG. 6, Z1 indicates an intersection of the areas accessible to the access point 100 under each single jammer J1, J2, J3, and J4, Z2 represents an area accessible to the access point 100 under four jammers J1, J2, J3, and J4 in the case of n=4, and Z3 shows an area accessible to the access point 100 under four jammers J1, J2, J3, and J4 in the case of n=2.

In FIG. 6, Z2 and Z3 are included in Z1, and as n is increased, the size of the area accessible to the access point 100 is increased to be approximated as Z1.

Table 2 shows the size of the secure wireless zone according to the loss exponent and the jammer's power. Referring to Table 2, the size of Z2 is 54_63% of Z1, and the size of Z3 is 86_90% of Z1.

TABLE 2

| | Area | $P_A$ | Size | Relative size |
|---|---|---|---|---|
| Case (a) | $Z_1$ | $4P_J$ (n = 4)<br>$2P_J$ (n = 2) | $1.72j^2$ | 100% |
| | $Z_2$ | $4P_J$ | $1.48j^2$ | 86.0% |
| | $Z_3$ | $2P_J$ | $1.09j^2$ | 63.4% |
| Case (b) | $Z_1$ | $P_J$ (n = 2 or 4) | $j^2$ | 100% |
| | $Z_2$ | $P_J$ | $0.91j^2$ | 90.8% |
| | $Z_3$ | $P_J$ | $0.63j^2$ | 63.2% |

TABLE 2-continued

| | Area | $P_A$ | Size | Relative size |
|---|---|---|---|---|
| Case (c) | $Z_1$ | $0.25P_J$ (n = 4)<br>$0.5P_J$ (n = 2) | $0.63j^2$ | 100% |
| | $Z_2$ | $0.25P_J$ | $0.55j^2$ | 87.8% |
| | $Z_3$ | $0.5P_J$ | $0.34j^2$ | 54.7% |

As described above, according to the exemplary embodiment of the present invention, information leakage can be fundamentally prevented by actually controlling the communication area of the access point compared to the existing logical wireless network protecting methods.

Further, the current invention is applicable to the general communication system since it does not depend on a special protocol but uses power of the jammer and a relative position of the terminal.

In addition, regarding the attempt for the jammer to escape from the radio channel, since the jammer influences the adjacent channel, the trial of escape can be prevented by extending the several number of the jamming channels of the jammer. In detail, 13 channels can be covered by jamming 4 to 5 channels in the 2.4 GHz bandwidth of the IEEE 802.11.

According to an embodiment of the present invention, a wireless communication system for geographically controlling a communication area caused by an access point by using jamming is provided.

The above-described embodiments can be realized through a program for realizing functions corresponding to the configuration of the embodiments or a recording medium for recording the program in addition to through the above-described device and/or method, which is easily realized by a person skilled in the art.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A wireless communication system for geographically controlling a communication area, comprising:

an access point for communicating with a terminal in a first area; and a jammer for generating noise for intercepting communication between the access point and the terminal in a second area, wherein a jamming boundary for dividing an area in which the terminal can communicate with the access point and an area in which the terminal cannot communicate with the access point in an area in which the first area and the second area are overlapped is formed, and a position of the jamming boundary is determined based on a ratio between power of a signal transmitted to the terminal by the access point and power of a signal of the noise.

2. The wireless communication system of claim 1, wherein, when power of the signal transmitted to the terminal by the access point corresponds to power of the noise, the jamming boundary is formed at a point having the same distance from the access point and the jammer, respectively.

3. The wireless communication system of claim 1, wherein the jamming boundary moves toward the access point as power of the noise is increased compared to power of a signal transmitted to the terminal by the access point.

4. The wireless communication system of claim 1, wherein the jamming boundary moves toward the jammer as power of the noise is decreased compared to power of a signal transmitted to the terminal by the access point.

5. The wireless communication system of claim 1, wherein the jamming boundary is proportional to the distance between the access point and the terminal and the distance between the jammer and the terminal.

6. The wireless communication system of claim 1, wherein signal power of the access point received by the terminal corresponds to power of the noise received by the terminal at the jamming boundary.

7. The wireless communication system of claim 1, wherein the signal to noise ratio for a signal from the access point on the boundary of the first area is 1, and the signal to noise ratio for a signal from the jammer on the boundary of the second area is 1.

* * * * *